US009974391B2

(12) United States Patent
Wan

(10) Patent No.: US 9,974,391 B2
(45) Date of Patent: May 22, 2018

(54) STORAGE STOOL

(71) Applicant: NANJING SUNRUN HOME TEXTILE CO., LTD., Nanjing (CN)

(72) Inventor: Qiuhu Wan, Nanjing (CN)

(73) Assignee: NANJING SUNRUN HOME TEXTILE CO., LTD., Nanjing (CN)

( * ) Notice: Subject to any disclaimer, the term of this patent is extended or adjusted under 35 U.S.C. 154(b) by 198 days.

(21) Appl. No.: 15/213,257

(22) Filed: Jul. 18, 2016

(65) Prior Publication Data

US 2018/0000250 A1 Jan. 4, 2018

(30) Foreign Application Priority Data

Jul. 1, 2016 (CN) ..... 2016 1 0518015

(51) Int. Cl.
*A47C 7/62* (2006.01)
*A47C 7/02* (2006.01)

(52) U.S. Cl.
CPC ..... *A47C 7/62* (2013.01); *A47C 7/021* (2013.01)

(58) Field of Classification Search
USPC ..... 297/440.12
See application file for complete search history.

(56) References Cited

U.S. PATENT DOCUMENTS 2,606,599 A * 8/1952 Santosuosso ..... A47C 3/16 297/188.1
3,181,913 A * 5/1965 Guido ..... A47C 3/16 297/423.41
3,663,058 A * 5/1972 Hirsch ..... A47C 4/02 297/423.41
3,751,845 A * 8/1973 van Leeuwen ..... A01K 97/05 206/542
4,232,477 A * 11/1980 Lin ..... A47C 4/54 297/462
4,361,356 A * 11/1982 Tunick ..... A47C 13/00 206/523
4,546,941 A * 10/1985 Hildebrand ..... A47C 5/005 108/115
4,970,831 A * 11/1990 Rota ..... A47C 4/04 297/129
4,984,848 A * 1/1991 Scalisi ..... A47C 5/005 248/152
8,240,770 B2 * 8/2012 Bertele ..... A47B 43/02 297/440.12
8,403,422 B2 * 3/2013 Wu ..... A47C 7/02 297/440.12
2008/0157582 A1 * 7/2008 Bertele ..... A47B 43/02 297/440.12
2017/0105535 A1 * 4/2017 Tang ..... A47C 7/62

* cited by examiner

*Primary Examiner* — David E Allred
(74) *Attorney, Agent, or Firm* — CBM Patent Consulting, LLC

(57) ABSTRACT

A storage stool comprises a barrel-shaped wall and an end cap. Side plates and fold lines are longitudinally arranged on the barrel-shaped wall. The end cap is embedded into the top of the barrel-shaped wall. Longitudinal stiffening ribs for supporting the end cap are arranged on the side plates. A cloth cover sleeves the barrel-shaped wall. A supporting ring is mounted at the top of the barrel-shaped wall, while a bottom plate is mounted at the bottom of the barrel-shaped wall.

8 Claims, 5 Drawing Sheets

STORAGE STOOL

This application claims priority to Chinese Patent Application Ser. No. CN201610518015.6 filed 1 Jul. 2016.

FIELD OF THE INVENTION

The present invention relates to the field of home supplies, and in particular, to a folding storage stool.

BACKGROUND OF THE INVENTION

A storage stool is a common stool that is added with a storage space therein, and thus can be used as a stool and also a storage box. Typically, the storage stool is made into a box shape, and designed with a folding structure, such that the volume thereof can be compressed in logistics and sales links, and a user can fold it for storage conveniently when not in use.

Upon search, Chinese patent document CN103986996U discloses a novel folding stool structure, which is composed of a non-folding stool cap and a folding stool seat. The stool cap sleeves the unfolded stool seat. The stool seat is polygonal and composed of a plurality of mutually connected plates, and a fold line is arranged longitudinally at the joint of every two adjacent plates. During folding, the stool seat is folded into a cube along the fold lines, and then the cube is put into the stool cap for convenient carrying.

The stool cap of such a folding stool generally is provided with a relatively deep edge. Using the edge of the stool cap to surround and constrain the polygonal top requires a relatively large fit clearance. During opening, the stool cap needs to be lifted up by two hands; and it is hard to open by one hand. Moreover, after the stool cap is opened, the top of the stool seat is not constrained any more; the polygonal shape deforms easily when stored articles are put into it, and the mouth of the stool seat needs to be reshaped by two hands before the stool cap is put back. It thus can be seen that although the existing folding stool has the storage function, it is inconvenient to put in and take out stored articles when in use. In addition, for bearing pressure and lateral shear force, the whole folding stool completely relies on the vertical homogeneous plate-shaped sidewalls in the stool seat; as a result, even if the stool seat is made thick enough, it will inevitably deform after being used for a period of time; and that is, the shape of such a folding stool cannot be maintained, thereby leading to a bad decorative effect. Hence, it has become a technical problem to be solved to design a storage stool stable in structure and easy to open, thereby improving the grade and competitiveness of the product.

SUMMARY OF THE INVENTION

Objective of the invention: the present invention provides a novel storage stool to overcome the defects in the prior art.

Technical solution: in order to solve the above technical problem, the storage stool provided by the present invention comprises a barrel-shaped wall on which side plates and fold lines are longitudinally arranged, and an end cap. The end cap is embedded into the top of the barrel-shaped wall; and longitudinal stiffening ribs for supporting the end cap are arranged on the side plates.

Preferably, transverse stiffening ribs are further arranged on the side plates and connected to the tops of the longitudinal stiffening ribs; and the bottom of each side plate is provided with an inward-reversed flanging.

Preferably, a cloth cover sleeves the barrel-shaped wall; and a bottom plate is mounted at the bottom of the barrel-shaped wall.

Preferably, a supporting ring is further mounted at the top of the barrel-shaped wall; an outer profile of the supporting ring is matched with an inner profile of the barrel-shaped wall, such that the supporting ring can be closely engaged between the end cap and the barrel-shaped wall.

Preferably, the barrel-shaped wall is an integrally molded barrel-shaped wall; and each fold line is a U-shaped groove connected between adjacent side plates.

Preferably, the end cap is in a hollowed-out structure; and a cloth cover sleeves the end cap.

Preferably, a handle is arranged on the end cap.

Preferably, the barrel-shaped wall is a cylindrical barrel-shaped wall or an elliptic cylindrical barrel-shaped wall; and the cross sections of the side plates are circular arcs forming a circumference.

Preferably, each longitudinal stiffening rib is right-angle-shaped, and two right-angle sides of the longitudinal stiffening rib are fixedly connected with the corresponding side plate and the corresponding transverse stiffening rib.

Preferably, holes for grabbing are formed in the bottom plate.

When in use, the cloth cover stitched by using soft cloth sleeves the barrel-shaped wall. Various patterns are personally customized on the cloth cover, for example, the appearances of bark and fruits. The end cap is also covered with a cloth soft cover that is made with sections of tree growth rings or fruits. As a result, the storage stool has a highly realistic visual effect, and the grade of the product is improved.

Beneficial effects: by adopting the structure of the stiffening ribs and the embedded end cap, the strength and the appearance integrity of the storage stool provided by the present invention are improved. The supporting ring is employed, such that the barrel-shaped wall does not deform even after the end cap is opened. The side plates of the barrel-shaped wall are in the circular-arc-shaped structure, and matched with the fold lines and the cloth cover, such that the barrel-shaped wall is convenient to fold for storage and also can be quickly and stably formed into the desired shape.

In addition to the technical problem to be solved by the present invention, the technical features constituting the technical solution, and the advantages resulting from the technical features of the technical solution all described above, other technical problems that can be solved by the storage stool of the present invention, other technical features included in the technical solution, and advantages brought by the technical features will be further described in detail in conjunction with accompanying drawings.

BRIEF DESCRIPTIONS OF THE DRAWINGS

Figure 1:
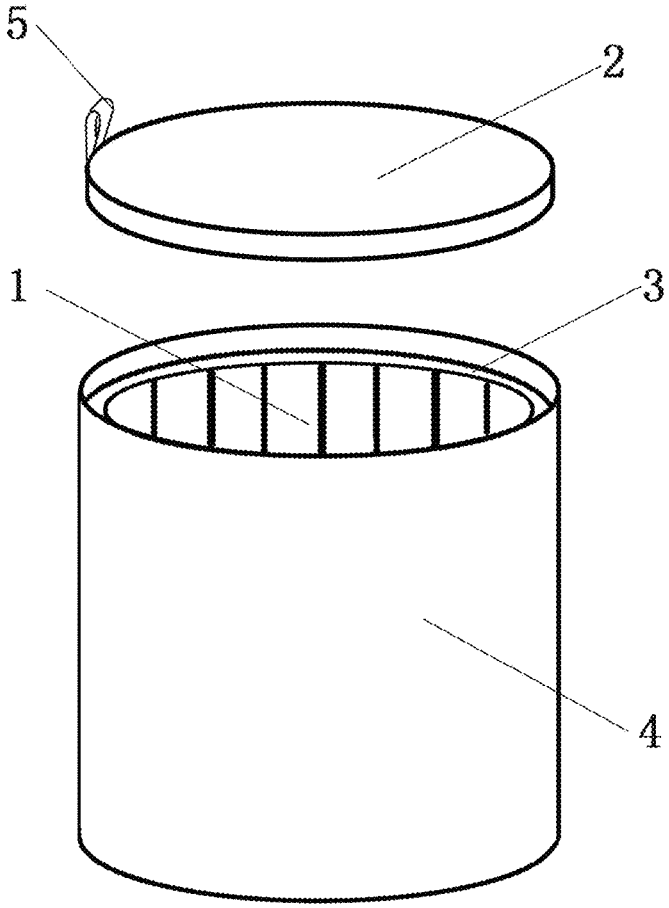
FIG. 1 is a structural schematic diagram of an embodiment of the present invention.

In the drawings, 1 represents barrel-shaped wall, 2 represents end cap, 3 represents supporting ring, 4 represents outer cover, 5 represents handle, 6 represents bottom plate, 101 represents side plate, 102 represents fold line, 103 represents longitudinal stiffening rib, 104 represents transverse stiffening rib, and 105 represents flanging.

DETAILED DESCRIPTION OF THE EMBODIMENTS

The storage stool of the present embodiment, as shown in FIG. 1, comprises a barrel-shaped wall 1 and an end cap 2. The barrel-shaped wall 1 is cylindrical. The end cap 2 is a circular plate. A supporting ring 3 is mounted on the inner side of the top of the barrel-shaped wall 1. An outer cover 4 sleeves the barrel-shaped wall 1. The outer cover 4 is stitched from soft cloth, and various patterns, such as appearances of bark and fruits, and the like, can be personally customized on the surface of the outer cover 4. The end cap 2 may also be covered with a cloth soft cover, and made with sections of tree growth rings or fruits. As a result, the storage stool has a good visual effect, and the grade of the product is improved. A handle 5 is further arranged on the end cap 2 to facilitate opening by one hand.

Figure 2:
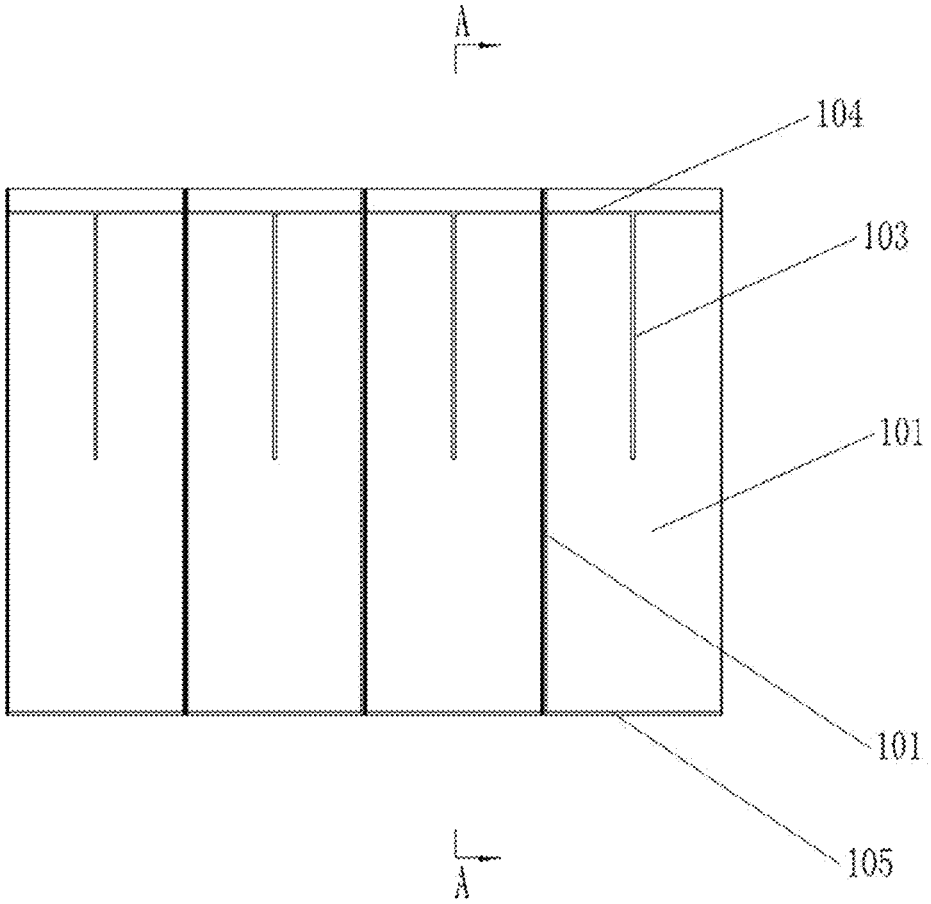
FIG. 2 is an expanded view of a barrel-shaped wall in FIG. 1.
Figure 3:
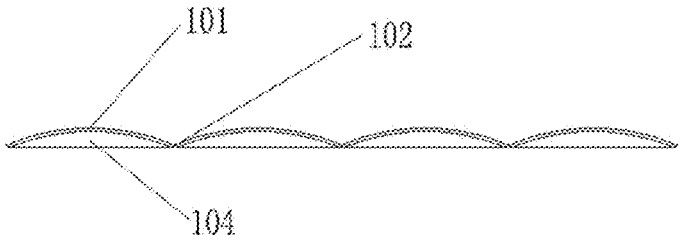
FIG. 3 is a vertical view of FIG. 2.
Figure 4:
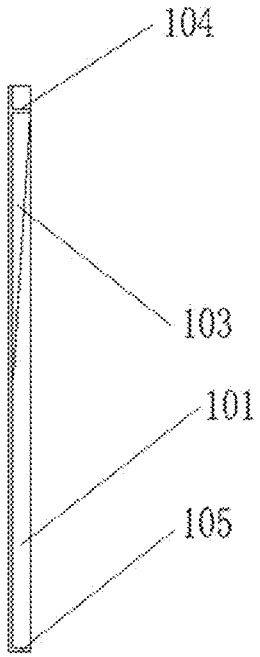
FIG. 4 is an A-A section view of FIG. 2.

As shown in FIG. 2, FIG. 3 and FIG. 4, the barrel-shaped wall is formed by a plurality of side plates 101 connected by means of fold lines 102. Each side plate 101 is made of a hard material, such as PP, PE, ABS and the like, and can be integrally molded through an injection molding process. A V-shaped groove or a U-shaped groove is formed at each fold line 102, such that the fold line 102 is thinner than each side plate 101. Bending is realized by means of the elasticity of the plastics, and therefore, the desired cylindrical barrel-shaped wall can be formed. For the sake of convenient manufacturing, the barrel-shaped wall may be evenly divided into eight ⅛ circular-arc-shaped side plates, and further, every four side plates are combined to form a semicircle. In such a manner, two semicircles are manufactured in twice by use of one mold, and then connected by means of an adhesive tape or in other connecting ways.

The cross section of each side plate 101 is one portion of a circumference. When eight side plates 101 are combined to form the barrel-shaped wall, the cross section of each side plate 101 is a ⅛ circular arc. Stiffening ribs are arranged on an inner side of each side plate 101, including a longitudinal stiffening rib 103 arranged axially along the barrel-shaped wall, and a transverse stiffening rib 104 close to the top; and the longitudinal stiffening rib 103 and the transverse stiffening rib 104 are connected into a T-shape. The transverse stiffening ribs 104 are capable of providing better support for the supporting ring, and the distance between the transverse stiffening ribs 104 and the top end of the barrel-shaped wall is equal to the thickness of the end cap, such that the end cap can be completely embedded into the barrel-shaped wall.

Each longitudinal stiffening rib 103 is right-angle-shaped, and two right-angle sides thereof are fixedly connected with the corresponding side plate 101 and the corresponding transverse stiffening rib 104. The bottom of each side plate 101 is further provided with an inward-reversed flanging 105 for supporting the bottom plate in the barrel-shaped wall. One side, connected with the corresponding side plate, of each transverse stiffening rib 104 is cambered, while the other side thereof is straight, thereby facilitating manufacturing and ejection of the mold. Each longitudinal stiffening rib 103, of which the length is preferably equal to ½ height of each side plate, is fixed to the central line of the upper half portion of the inner side of the corresponding side plate.

Figure 5:
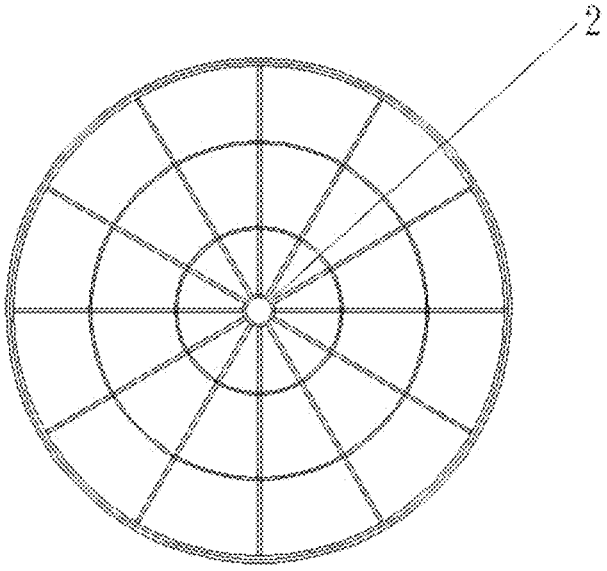
FIG. 5 is a structural schematic diagram of an end cap in FIG. 1.

As shown in FIG. 5, the end cap 5 is of a hollowed-shaped structure, and spider web-shaped; and the material can be saved to an utmost extent while the strength in use is guaranteed. When in use, the cloth soft cover is used for covering so as to realize the decoration function. The handle is directly stitched to the cloth soft cover.

Figure 6:
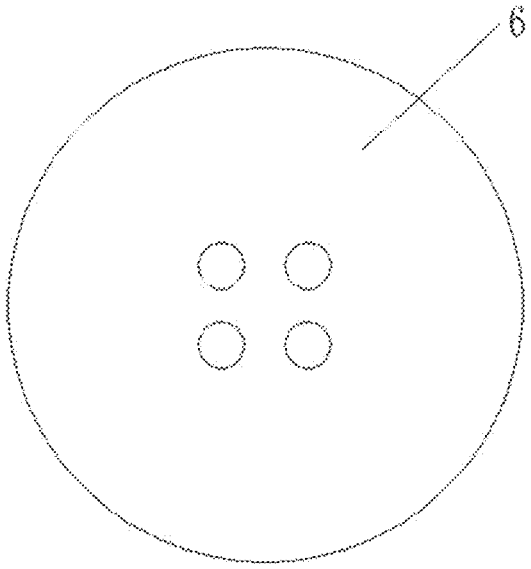
FIG. 6 is a structural schematic diagram of a bottom plate.

As shown in FIG. 6, the bottom plate 6 is a circular plate of which the diameter is equal to the inner diameter of the barrel-shaped wall, and has certain elasticity so as to be embedded into the barrel-shaped wall conveniently. Further, holes for grabbing are formed in the bottom plate 6.

Figure 7:
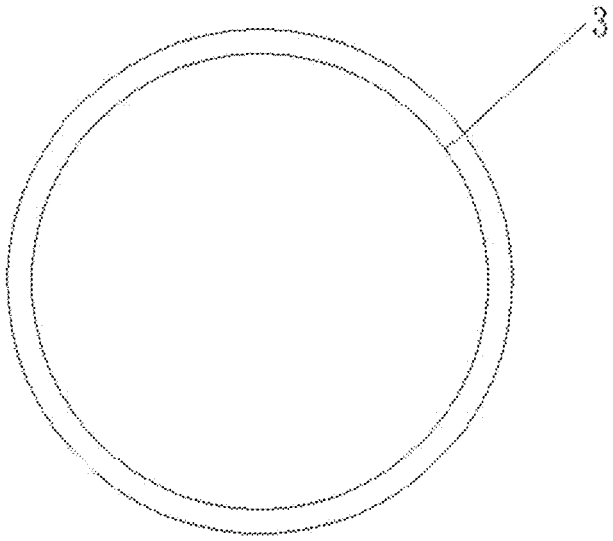
FIG. 7 is a structural schematic diagram of a supporting ring in FIG. 1.

As shown in FIG. 7, the outer diameter of the supporting ring 3 is equal to the inner diameter of the barrel-shaped wall. The supporting ring 3 has a certain width, and supports the top of the barrel-shaped wall from the inside. When the end cap is opened, the supporting ring 3 is still capable of providing circumferential and radial support for the mouth of the barrel and keeping the shape of the barrel-shaped wall. During load bearing, the pressure from the end cap is uniformly transferred to the barrel-shaped wall by means of the surface of the supporting ring 3.

Figure 8:
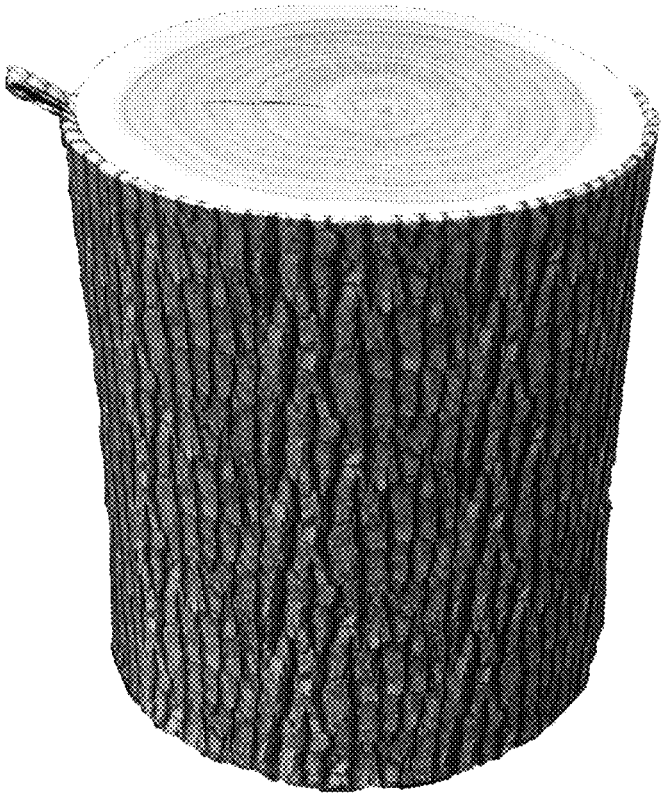
FIG. 8 is a use effect drawing of the embodiment of the present invention.

FIG. 8 shows the use effect drawing of the product. By use of the above technical means, in particular the structure of various embedded supports and end cap, the appearance effect of the product is highly realistic.

A magic tape can be arranged by a circle on the inner side of the top edge of the barrel-shaped barrel. The cloth cover is made into a cylindrical bag, and a magic tape is also arranged by a circle along the inner edge of the top of the cloth cover, such that the cloth sleeve can be quickly and stably mounted on the barrel-shaped wall. Cloth covers with different patterns are replaced on the same barrel to realize different decoration effects, thereby meeting the requirements of different users. Moreover, once the barrel and the cloth cover are defined with standard sizes, mass production can be carried out by means of injection molding and stitching. Products of different styles can be produced just by using cloth with different patterns without replacing production equipment and process parameters, and simultaneously, supplied to different markets.

A manufacturing method of the storage stool comprises injection molding manufacturing of the barrel-shaped wall, the end cap, the bottom plate and the supporting ring, stitching of the cloth cover, and arrangement of the magic tape or other fasteners on the barrel-shaped wall and the cloth cover. The above parts are packed in a flat package mode to facilitate transportation and distribution. According to the appearance characteristic of the product, a box with a window or other color printed gift boxes can be adopted to pack the product. After the product is bought by a user, the barrel-shaped wall is unfolded first, and then the bottom plate and the supporting ring are engaged into the inside bottom and the inside top of the barrel-shaped wall, respectively; and finally, the cloth covers sleeve the barrel-shaped wall and the barrel cap, thereby completing the assembly of the product.

The embodiment of the present invention is described above in detail in conjunction of the accompanying drawings. However, the present invention is not limited to the described embodiment. The barrel-shaped wall may also be made into an elliptical shape or other shapes by using the above structure of the side plates and the stiffening ribs. The connection of the side plates may also be realized by means of such structures as a bonding soft material, a hinge, and the like.

For ordinarily skilled in the art, various alterations, modifications, substitutions and transformations made to the embodiments within the scope of the principle and the technical concept of the present invention still fall into the protection scope of the present invention.

What is claimed is:

1. A storage stool, comprising a barrel-shaped wall formed from a plastic material integrally molded to include a plurality of elongate side plates and fold lines that are disposed along a length of the wall that is bent at the fold lines to form the barrel shape, and an end cap, wherein the end cap is embedded into a top of the barrel-shaped wall; and respective longitudinal stiffening ribs extending lengthwise along lengths of the side plates and respective transverse stiffening ribs extending lengthwise along widths of the side plates and connected to tops of the longitudinal stiffening ribs to form respective T-shapes, the T-shapes supporting the end cap; the bottom of each side plate is provided with a flange protruding inwardly relative to the barrel shape; wherein the barrel-shaped wall is a circular cylindrical barrel-shaped wall or an elliptic cylindrical barrel-shaped wall, and cross sections of the side plates comprise arcs forming a circumference of the barrel-shaped wall; and wherein the ribs and flanges are integrally molded with the barrel-shaped wall.

2. The storage stool according to claim 1, wherein a cloth cover sleeves the barrel-shaped wall, and a bottom plate is mounted at the bottom of the barrel-shaped wall.

3. The storage stool according to claim 1, wherein a supporting ring is further mounted at the top of the barrel-shaped wall, and an outer profile of the supporting ring is matched with an inner profile of the barrel-shaped wall.

4. The storage stool according to claim 1, wherein the barrel-shaped wall is an integrally molded barrel-shaped wall, and each fold line is a U-shaped groove connected between adjacent side plates.

5. The storage stool according to claim 1, wherein the end cap is in a hollowed-out structure, and a cloth cover sleeves the end cap.

6. The storage stool according to claim 5, wherein a handle is arranged on the end cap.

7. The storage stool according to claim 1, wherein each longitudinal stiffening rib is right-angle-shaped, and two right-angle sides of the longitudinal stiffening rib are fixedly connected with a respective side plate and a respective transverse stiffening rib.

8. The storage stool according to claim 2, wherein holes for grabbing are formed in the bottom plate.

* * * * *